United States Patent [19]

Conrad et al.

[11] 4,126,585

[45] Nov. 21, 1978

[54] 2-METHYL-2-ETHYL-HEXANOATE ESTER PERFUME COMPOSITIONS

[75] Inventors: Jens Conrad, Hilden; Ulf-Armin Schaper, Dusseldorf; Klaus Bruns, Krefeld-Traar, all of Fed. Rep. of Germany

[73] Assignee: Henkel Kommanditgesellschaft auf Aktien (Henkel KGaA), Dusseldorf-Holthausen, Fed. Rep. of Germany

[21] Appl. No.: 802,787

[22] Filed: Jun. 2, 1977

[30] Foreign Application Priority Data

Jun. 11, 1976 [DE] Fed. Rep. of Germany ..... 2626142

[51] Int. Cl.[2] ..... C11B 9/00

[52] U.S. Cl. ..... 252/522; 560/261; 560/265; 252/8.6; 252/89 R; 252/108; 252/305; 424/64; 428/350

[58] Field of Search ..... 252/522; 560/261, 265

[56] References Cited

U.S. PATENT DOCUMENTS

| | | | |
|---|---|---|---|
| 3,093,681 | 6/1963 | Eichmann | 252/522 |
| 3,760,087 | 9/1973 | Hajos et al. | 252/522 |
| 3,859,366 | 1/1975 | Schleppnik | 252/522 |
| 3,928,402 | 12/1975 | Näf | 252/522 |
| 3,948,816 | 4/1976 | Helmlinger | 252/522 |
| 4,033,993 | 7/1977 | Bruns | 252/522 |

*Primary Examiner*—Veronica O'Keefe

*Attorney, Agent, or Firm*—Hammond & Littell

[57] ABSTRACT

2-Methyl-2-alkyl-alkanoic acid esters of the formula

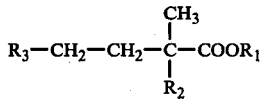

wherein $R_1$ is a saturated or unsaturated, straight- or branched-chain aliphatic hydrocarbon radical having 1 to 5 carbon atoms, and $R_2$ and $R_3$ are independently an alkyl radical having 1 to 4 carbon atoms, which compounds have a wide variety of pleasing and persistent fragrances, and perfume compositions containing them.

9 Claims, No Drawings

2-METHYL-2-ETHYL-HEXANOATE ESTER PERFUME COMPOSITIONS

OBJECTS OF THE INVENTION

An object of the present invention is the development of ester compounds having very natural, pleasing and persistent scents, useful as perfumes.

Another object of the present invention is the production of 2-methyl-2-alkyl-alkanoic acid esters of the formula

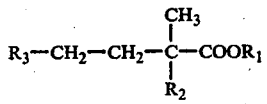

wherein $R_1$ is a saturated or unsaturated, straight- or branched-chain aliphatic hydrocarbon radical having 1 to 5 carbon atoms, and $R_2$ and $R_3$ are independently an alkyl radical having 1 to 4 carbon atoms as perfumes.

A yet further object of the present invention is the production of a perfumery composition consisting essentially of from 1% to 50% by weight of the above 2-methyl-2-alkyl-alkanoic acid esters and the remainder customary perfume constituents.

A still further object of the present invention is the improvement in the process of supplying a pleasing odor to a product by incorporating a perfume therein, by utilizing from 0.05 to 2% by weight of the above 2-methyl-2-alkyl-alkanoic acid esters as said perfume.

These and other objects of the invention will become more apparent as the description thereof proceeds.

DESCRIPTION OF THE INVENTION

It has been found that 2-methyl-2-alkyl-alkanoic acid esters of the general formula

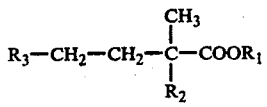

wherein $R_1$ is a saturated or unsaturated, straight- or branched- chain aliphatic hydrocarbon radical having 1 to 5 carbon atoms, and $R_2$ and $R_3$ are an alkyl radical having 1 to 4 carbon atoms, are valuable new perfumes having a very natural and complex scent.

More particularly the present invention relates to 2-methyl-2-alkyl-alkanoic acid esters of the formula

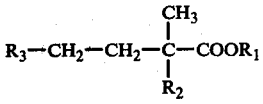

wherein $R_1$ is a member selected from the group consisting of alkyl having 1 to 5 carbon atoms, alkenyl having 3 to 5 carbon atoms and alkynyl having 3 to 5 carbon atoms and $R_2$ and $R_3$ are the same or different alkyl radicals having 1 to 4 carbon atoms, and to perfumed compositions containing these esters.

The esters of the invention can be produced in a particularly advantageous manner by reacting the corresponding 2-methyl-2-alkyl-alkanoyl chloride with the corresponding alkali alcoholate. Alternatively, however, other conventional esterification methods may be used. For example, the esters of 2-methyl-2-ethyl-hexanoic acid can be obtained by reacting esters of 2-methyl-butyric acid with n-butyl bromide in ethylene glycol dimethyl ether in the presence of sodium hydride, as described by R. E. Pincock and J. H. Rolston in J. Org. Chem. 29 (1964), page 2990 ff.

The 2-methyl-2-alkyl-alkanoic acids, from which the 2-methyl-2-alkyl-alkanoic acid esters of the invention are derived, can be produced by generally known methods, in accordance with Reppe, Koch, or others, by carbonylation reactions of vinylidene olefins or other suitable starting products such as primary alcohols or halides, as is further described in the monograph Methodicum Chimicum, Vol. 5, page 530 ff., Academic Press 1975. The esters can then also be partially and directly formed. The reactions take place in accordance with the following scheme;

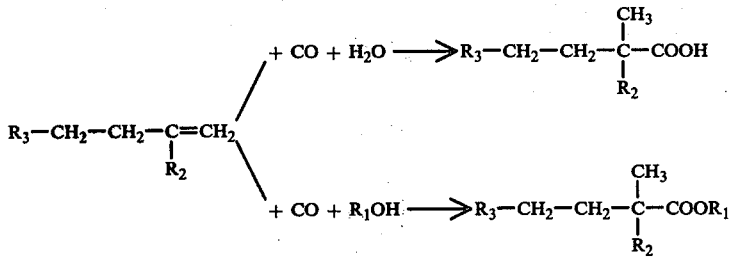

wherein $R_1$, $R_2$ and $R_3$ are as defined above.

In the cases in which $R_2$ is the same as $R_3$, the vinylidene olefins, required for the carbonylation reaction, can be produced by the following methods:

Method A: Aldol condensation of aldehydes having 3 to 6 carbon atoms, subsequent hydrogenation to form alcohol and dehydration to form vinylidene olefins.

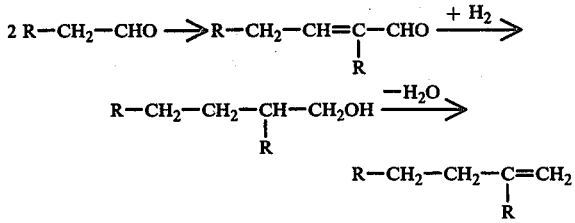

$R = CH_3$ to $C_4H_9$

Method B: Guerbet reaction of primary alcohols having 3 to 6 carbon atoms produces corresponding branched primary alcohols from which the vinylidene olefins are produced by dehydration.

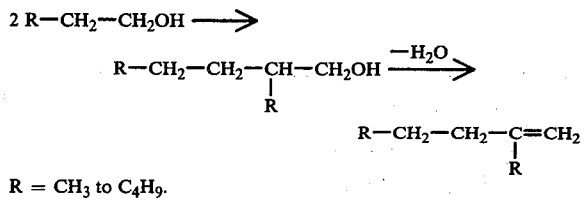

R = $CH_3$ to $C_4H_9$.

Examples of the perfume esters in accordance with the invention are the methyl-, ethyl-, propyl-, i-propyl-, n-butyl-, sec.butyl-, 2-methyl-propyl-, tert. butyl-, amyl-, allyl-, methallyl-, crotyl-, 1,1-dimethyl-propenyl-(2)-, and propargyl esters of the following carboxylic acids: 2,2-dimethyl-pentanoic acid, 2-methyl-2-ethyl-pentanoic acid, 2-methyl-2propyl-pentanoic acid, 2,5-dimethyl-2-isopropyl-hexanoic acid, 2-methyl-2-butyl-pentanoic acid, 2,2-dimethyl-hexanoic acid, 2-methyl-2-ethyl-hexanoic acid, 2-methyl-2-propyl-hexanoic acid, 2-methyl-2-butyl-hexanoic acid, 2,2-di-methyl-hepatnoic acid, 2-methyl-2-ethyl-heptanoic acid, 2-methyl-2-propyl-heptanoic acid, 2,6-dimethyl-2-sec-butyl-heptanoic acid, 2,5,5-trimethyl-2-tert.-butyl-hexanoic acid, 2-methyl-2-butyl-heptanoic acid, 2,2-dimethyl-octanoic acid, 2-methyl-2-ethyl-octanoic acid, 2-methyl-2-propyl-octanoic acid, and 2-methyl-2-butyl-octanoic acid.

A preferred embodiment of the perfume esters of the invention are the esters of 2-methyl-2-ethyl-hexanoic acid, such as its methyl-, ethyl-, propyl-, i-propyl-, n-butyl-, sec. butyl-, 2-methyl-propyl-, tert.butyl-, amyl-, allyl-, methallyl-, crotyl-, 1,1-dimethyl-propenyl-(2)-, and propargyl esters. Particularly suitable are the methyl-, ethyl-, allyl- and propargyl estes of 2-methyl-2-ethyl-hexanoic acid.

The esters in accordance with the invention, constitute valuable perfumes having characteristic fragrances. They are characterized by a powerful fragrance and by a particularly high degree of persistence. A further advantage is that they can be combined in a very satisfactory manner to produce novel nuances of fragrance.

The perfume esters in accordance with the invention can be mixed with other perfumes in a wide range of quantity ratios to form novel perfume compositions. However, in general, the proportion of the 2-methyl-2-alkyl-alkanoic acid esters in the perfume compositions will be from 1 to 50 percent by weight relative to the total composition. The remainder of the composition is conventional perfume constituents. Such compositions can act directly as perfumes or, alternatively, can be used to perfume cosmetics such as creams, lotions, toilet waters, aerosols, toilet soaps, etc. Alternatively, however, they may be used to improve the odor of technical products such as washing and cleaning agents, disinfectants, agents for treating textiles, etc., as is also possible in the case of the new compounds themselves.

The invention thus also includes a process of imparting a pleasing odor to a product comprising adding thereto from 0.05% to 2% by weight, relative to the total product, of at least one aliphatic 2-methyl-2-alkyl-alkanoate ester of the invention as a scenting agent.

The present invention will now be further described by means of the following Examples which are not to be limitative in any manner.

EXAMPLES

The production of the 2-methyl-2-alkyl-alkane acid esters, to be used in accordance with the invention, will be described in the first instance.

EXAMPLE 1 Ethyl 2-methyl-2-ethyl-hexanoate (A) Production of 2-methyl-2-ethyl-hexanoyl chloride 316 gm (2moles) of 2-methyl-2-ethyl-hexanoic acid were heated to boiling with 357 gm (3 moles) of thionyl chloride under agitation until the evolution of gas had ended. The surplus thionyl chloride was distilled off and the residue was fractionated in vacuo. 320 gm (90% of theory) of 2-methyl-2-ethyl-hexanoyl chloride of b.p. 78° C. at 13 mmHg were obtained.

(B) Production of ethyl 2-methyl-2-ethyl-hexanoate 11.5 gm (0.5 mole ) of sodium were dissolved in 150 ml of ethanol. 44 gm (0.25 mole) of 2-methyl-2-ethyl-hexanoyl chloride were slowly added under agitation to the solution of sodium ethylate at O° to 5° C. The mixture was subsequently agitated for 3 hours at room temperature, filtered, absorbed in ether, washed neutral with water, dried, reduced, and fractionated in vacuo. The ethyl 2-methyl-2-ethyl-hexanoate was obtained in the form of a colorless oil having a fruity/fresh odor with a fragrance of apple and camomile.

| Characteristics: | |
|---|---|
| Boiling point | 85° C at 14 mmHg |
| Refractive index | $n_D^{20}$ = 1.4210 |

The esters presented hereinafter were obtained in an analogous manner to that set forth above, using 2-methyl-2-ethyl-hexanoyl chloride and the appropriate sodium alcoholate in each case.

EXAMPLE 2

| Methyl 2-methyl-2-ethyl-hexanoate | |
|---|---|
| Characteristics: | |
| Appearance | colorless oil |
| Odor | fresh, peppermint-like with a menthol fragrance |
| Boiling point | 75° C at 14mmHg |
| Refractive index | $n_D^{20}$ = 1.4228 |

EXAMPLE 3

| N-Propyl 2-methyl-2-ethyl-hexanoate | |
|---|---|
| Characteristics: | |
| Appearance | colorless oil |
| Odor | fresh fruity |
| Boiling point | 60° C at 0.4mmHg |
| Refractive index | $n_D^{20}$ = 1.4243 |

EXAMPLE 4

| Isopropyl 2-methyl-2-ethyl-hexanoate | |
|---|---|
| Characteristics: | |
| Appearance | colorless oil |
| Odor | sweet fruity |
| Boiling point | 91° C at 15mmHg |
| Refractive index | $n_D^{20}$ = 1.4185 |

EXAMPLE 5

| N-butyl 2-methyl-2-ethyl-hexanoate | |
|---|---|
| Characteristics: | |
| Appearance | colorless oil |
| Odor | flowery fruity |
| Boiling point | 69° C at 1mmHg |
| Refractive index | $n_D^{20} = 1.4272$ |

EXAMPLE 6

| Isobutyl 2-methyl-2-ethyl-hexanoate | |
|---|---|
| Characteristics: | |
| Appearance | colorless oil |
| Odor | warm fruity fragrance |
| Boiling point | 67° C at 0.4mmHg |
| Refractive index | $n_D^{20} = 1.4248$ |

EXAMPLE 7

| Tert. butyl 2-methyl-2-ethyl-hexanoate | |
|---|---|
| Characteristics: | |
| Appearance | colorless oil |
| Odor | distinctly fresh fragrance |
| Boiling point | 48° C at 1mmHg |
| Refractive index | $n_D^{20} = 1.4193$ |

EXAMPLE 8

| Alkyl 2-methyl-2-ethyl hexanoate | |
|---|---|
| Characteristics: | |
| Appearance | colorless oil |
| Odor | straw and mushrooms with a milk fragrance |
| Boiling point | 98° C at 14mmHg |
| Refractive index | $n_D^{20} = 1.4341$ |

EXAMPLE 9

| Propargyl 2-methyl-2-ethyl-hexanoate | |
|---|---|
| Characteristics: | |
| Appearance | colorless oil |
| Odor | fruity odor with the fragrance of geraniums |
| Boiling point | 108° C at 20mmHg |
| Refractive index | $n_D^{20} = 1.4403$ |

All the compounds given in the above Examples have natural, fresh, powerful fragrances with excellent clinging properties or persistency which render them suitable for producing a wide variety of perfume compositions. Such compositions can be used to perfume a wide variety of products, such as cosmetics, washing agents, soaps as well as technical products in concentrations of approximately 1 to 50 percent by weight. Examples of perfumery compositions having a content of the new perfume esters in accordance with the invention are given hereinafter.

EXAMPLES 10

| Peppermint base perfume composition | |
|---|---|
| Methyl 2-methyl-2-ethyl-hexanoate | 300 parts by weight |
| 1-menthol | 300 parts by weight |
| 1-menthyl acetate | 190 parts by weight |
| Menthofuran | 50 parts by weight |

-continued

| Peppermint base perfume composition | |
|---|---|
| Piperitone | 25 parts by weight |
| 1-carvone | 15 parts by weight |
| Pulegone | 30 parts by weight |
| Eucalyptus oil | 80 parts by weight |
| Menthone | 10 parts by weight |
| | 1000 parts by weight |

EXAMPLE 11

| Apple blossom base perfume composition | |
|---|---|
| Ethyl 2-methyl-2-ethyl-hexanoate | 100 parts by weight |
| Linalool | 230 parts by weight |
| Ylang-ylang oil I | 100 parts by weight |
| Nerolidol | 70 parts by weight |
| Guaien | 50 parts by weight |
| Jammelia (IFF) | 50 parts by weight |
| Phenylethyl alcohol | 40 parts by weight |
| Neroli oil bigarade | 40 parts by weight |
| Terpinol | 40 parts by weight |
| Benzyl acetate | 40 parts by weight |
| Nerol | 40 parts by weight |
| Dimethylbenzylcarbinol | 30 parts by weight |
| Rhodinol | 25 parts by weight |
| Citronellyl formate | 25 parts by weight |
| Nerolidyl acetate | 20 parts by weight |
| Lavendar oil | 20 parts by weight |
| Bergamot oil | 15 parts by weight |
| Cinnamyl acetate | 15 parts by weight |
| Anisic aldehyde | 10 parts by weight |
| trans-2-hexanol diethyl acetal 10% | 10 parts by weight |
| Heliotropin | 10 parts by weight |
| Linalyl isovalerate | 5 parts by weight |
| Iris absolute 10% | 5 parts by weight |
| Tonka absolute | 5 parts by weight |
| Versalid | 5 parts by weight |
| | 1000 parts by weight |

EXAMPLE 12

| Soap perfume composition | |
|---|---|
| Citrenes | 450 parts by weight |
| Ethyl 2-methyl-2-ethyl-hexanoate | 325 parts by weight |
| Methyl anthralinate | 100 parts by weight |
| Indole | 5 parts by weight |
| Bergamot oil | 70 parts by weight |
| Tolu balsam | 50 parts by weight |

This soap perfume composition is added to a toilet soap in amounts of from 0.5 to 1% by weight.

The preceeding specific embodiments are illustrative of the practice of the invention. It is to be understood, however, that other expedients known to those skilled in the art or disclosed herein may be employed without departing from the spirit of the invention or the scope of the appended claims.

We claim:

1. A perfumery composition comprising from about 1% to 50% by weight of at least one 2-methyl-2-ethyl-hexanoate ester of the formula

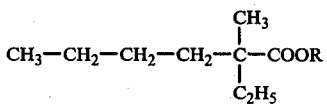

wherein R is a member selected from the group consisting of alkyl having from 1 to 5 carbon atoms, alkenyl having from 3 to 5 carbon atoms and alkynyl having from 3 to 5 carbon atoms, and the remainder customary constituents of perfumery compositions.

2. The perfumery composition of claim 1 wherein R is a member selected from the group consisting of methyl, ethyl, propyl, i-propyl, n-butyl, sec. butyl, 2-methyl-propyl, tert. butyl, amyl, allyl, methallyl, crotyl, 1-1-dimethyl-propenyl-(2), and propargyl.

3. The perfumery composition of claim 1 wherein R is a member selected from the group consisting of ethyl, methyl, n-propyl, isopropyl, n-butyl, isobutyl, tert. butyl, allyl and propargyl.

4. The perfumery composition of claim 1 wherein R is a member selected from the group consisting of methyl, ethyl, allyl and propargyl.

5. The perfumery composition of claim 1 which contains, in addition to the 2-methyl-2-ethyl-hexanoate ester or mixture of such esters, one or more other perfumes.

6. The perfumery composition of claim 1 wherein R is alkyl.

7. The perfumery composition of claim 1 wherein R is alkenyl.

8. The perfumery composition of claim 1 wherein R is alkynyl.

9. A method of imparting a pleasing odor to a product comprising adding thereto from 0.05% to 2% by weight, relative to the total product, of the aliphatic 2-methyl-2-ethyl-hexanoate ester of claim 1 as a scenting agent.

* * * * *